United States Patent [19]

Masse

[11] Patent Number: 4,840,235

[45] Date of Patent: Jun. 20, 1989

[54] IMPACT HAMMER ASSEMBLY FOR DRILLING ROCK

[76] Inventor: Roger Masse, 131 Roussin, Thetford Mines, Quebec, Canada, G6G 1N6

[21] Appl. No.: 181,497

[22] Filed: Apr. 14, 1988

[51] Int. Cl.[4] ..... B23B 15/16

[52] U.S. Cl. ..... 173/104; 173/111

[58] Field of Search ..... 173/104, 111, 134, 133, 173/125, 160

[56] References Cited

U.S. PATENT DOCUMENTS 1,644,110 10/1927 Coven et al. ..... 173/133

3,199,594 8/1965 Kinley ..... 173/133

4,359,109 11/1982 Truong-Cao ..... 173/111

*Primary Examiner*—Frank T. Yost

*Assistant Examiner*—Willmon Fridie, Jr.

*Attorney, Agent, or Firm*—Steele, Gould & Fried

[57] ABSTRACT

An impact hammer assembly for use on a drill head intended for drilling hard material, such as rock. The hammer comprises an elongated hollow case opened at one end and a drill bit provided with a rear stem that is mounted in the hollow case, through its open end, for free rotation and limited slidable displacement. A pair of pins extends transversally through the case on either side of the stem of the drill bit to retain the same in the case.

11 Claims, 2 Drawing Sheets

IMPACT HAMMER ASSEMBLY FOR DRILLING ROCK

BACKGROUND OF THE INVENTION

1. Field of the Invention

The present invention is concerned with a very specific improvement to the drill head forming the subject matter of U.S. Pat. No. 4,410,053 granted on Oct. 18, 1983 to Roger MASSE, which drill head is intended to be used for drilling hard material such as rock.

More particularly, the invention is concerned with a new impact hammer assembly for use on such a drill head.

2. Description of the Prior Art

The drill head disclosed and claimed in the above mentioned U.S. Pat. No. 4,410,053 generally comprises a number of impact hammer assemblies distributed about a central support having a like number of flat faces onto each one of which an impact hammer assembly is carried. The assemblies are located around the central support, so that the impact hammers stand at different radial distances from a rotary mounting spindle to which the central support is end-connected. With such a construction, the front of hard material to be drilled is fragmented by impact along concentric, spaced apart, circular paths and by shear between these paths. The head serves, as is known, to drill large holes through rock, in a single pass, by impacting the rock in selected areas to fragment it.

While this drill head is quite efficient, its use presents several drawbacks due to its particular construction.

A major one of these drawbacks is the manner in which the hammers are fixed to the central support. This is done, in the case of each hammer assembly, by means of a pair of pillow-blocks, each involving a half cylindrical seat fixed to the central support, as by welding, and into which seat one end of the cylindrical case of the hammer rests, being clamped therein by a metal strap bolted to the seat and forcing the hammer case against it. Under the severe action of the impact hammers, it will be appreciated that the bolts of the pillow-blocks either rapidly become loose or the straps or seat break, necessitating break-down of the operation for tightening of the bolts or for repair.

Another major drawback of the drill head of U.S. Pat. No. 4,410,053, is that its driver sub-member which receives the drill bit is screwed into the corresponding end of the hammer case. This member becomes loose under the severe blows applied to it by the repeated hammering action of the drill bit, rendering break-down adjustment necessary.

In U.S. Pat. No. 4,410,053, it is also suggested to drive the fragmenting head or drill bit of every impact hammer to make it rotate about its longitudinal axis during the drilling operation. The very purpose of this rotation which is, in practice, positively controlled by a motor contained in the case of each hammer, was allegedly to reduce wearing of the drill bit teeth. After several years of extensive use and testing, it has however been found that such a reduction in wearing of the teeth was not attained, possibly due to the uneven roughness of the rock surface to be drilled by impact.

In order to tentatively overcome or at least reduce the first drawback mentioned hereinabove, it has been suggested by Mr. Roger MASSE, in his U.S. patent application Ser. No. 038,768 filed on Apr. 15, 1987, to use impact hammer assemblies each provided with a one-piece cast case including a connection flange on each side of its longitudinal axis. These flanges which preferably extend the full length of the case, can be bolted to the central support, thereby transmitting the hammer blows directly to the support and thus appreciably reducing any tendency of the bolts to become loose.

To overcome the second drawback mentioned hereinabove and thus avoid loosening of the driver submember, it has also been suggested in the same U.S. patent application Ser. No. 038,768 to use impact hammer assemblies each comprising a one-piece cast case formed with radial connection ears at the "sub end" thereof. Each assembly also comprises a driver submember which has radial connection ears operatively engaging over the case connection ears while bolt means releasably secure the drive sub-member and case together through the connection ears. Preferably, the driver sub-member is also a one-piece cast metal member having an axial protrusion which is snugly received into the body housing. The driver sub-member is formed with a through bore coaxial with the body longitudinal axis and opening into the hammer case.

To overcome the third and last deficiency listed hereinabove, it has further been suggested by Mr MASSE in his U.S. patent application Ser. No. 038,768, to use a spline and groove connection between the stem of the bit and its receiving drive sub-member, to prevent any rotation of this bit. This solution has been tested for a while but has not proved to be really satisfactory to improve the resistance property of the bit teeth.

OBJECTS OF THE INVENTION

An object of the present invention is to provide a new impact hammer assembly whose structure overcomes or at least largely reduces the above mentioned drawbacks of the prior art.

Another object of the invention is to provide a new impact hammer assembly whose structure is such that the life duration of the drill bit used therein is appreciably lengthened.

A further object of the invention is to provide a new impact hammer assembly which is simple in structure and whose drill bit may be easily replaced whenever necessary, thereby making maintenance of the drill head much easier to carry out.

SUMMARY OF THE INVENTION

The present invention is based on the discovery that the best approach to increasing the life expectancy of the drill bit is to give it complete freedom of rotation with respect to the case carrying it while limiting, of course, the stroke of its rectilinearly reciprocating motion. It was indeed assumed by the present inventors that the teeth of the drill bit would then adjust themselves better and more readily to the varying degree of roughness of the rock surface, immediately upon impact, by avoiding too large a blow on a limited number of teeth or, in other words, distributing the impact force more evenly between the teeth. Extensive studies and tests have shown an important improvement in this respect and appear to support the aforesaid assumption.

Accordingly, the present invention proposes a new impact hammer assembly for use on a drill head intended for drilling hard material such as rock, which assembly comprises an elongated case having a longitudinal axis and comprising an inner housing opening at one end of the case. A drill bit is mounted into the case. This bit has a forward impact head extending out of it inner housing and a rearward stem extending within the inner housing.

In accordance with a very important aspect of the invention, this stem is free to rotate and free to slide in the housing about and along the longitudinal axis thereof.

Impact motor means are also mounted in the inner housing. These impact motor means include a linearly reciprocable impact piston mounted behind the drill bit, and means for imparting a reciprocating motion to this impact piston to cause the same to repeatedly hit the stem of the drill bit for this bit head to impact the hard material.

Means are of course provided for retaining the drill bit in the housing. In accordance with another very important aspect of the invention, these retaining means include a pair of pins extending transversally across the elongated case. These pins pass through the inner housing on either side of the stem of the drill bit and act either directly or indirectly as stop means inside this housing to limit the slidable displacement of the stem without interfering with the free rotation of the same.

In accordance with a preferred embodiment of the invention, the impact hammer assembly may also comprise a radial flange outwardly projecting at the other end of the elongated case which is opposite to the one opened end thereof. This flange acts as a seat to mount the case onto a flat base and may comprise a plurality of bolt-receiving holes to allow fixation of the case onto the flat base.

The impact hammer assembly may also comprise a fastening bracket comprising a short connection plate rigidly connected to the elongated case close to the one opened end thereof. This connection plate preferably extends tangentially to the case and may comprise a plurality of bolt-receiving holes.

Advantageously, this connection plate extends parallel to the pins passing through the housing to give easy access to these pins.

These and other features of the invention will appear in the description that follows of a preferred embodiment of the invention having reference to the appended drawings.

DESCRIPTION OF THE PREFERRED EMBODIMENT

Figure 1:
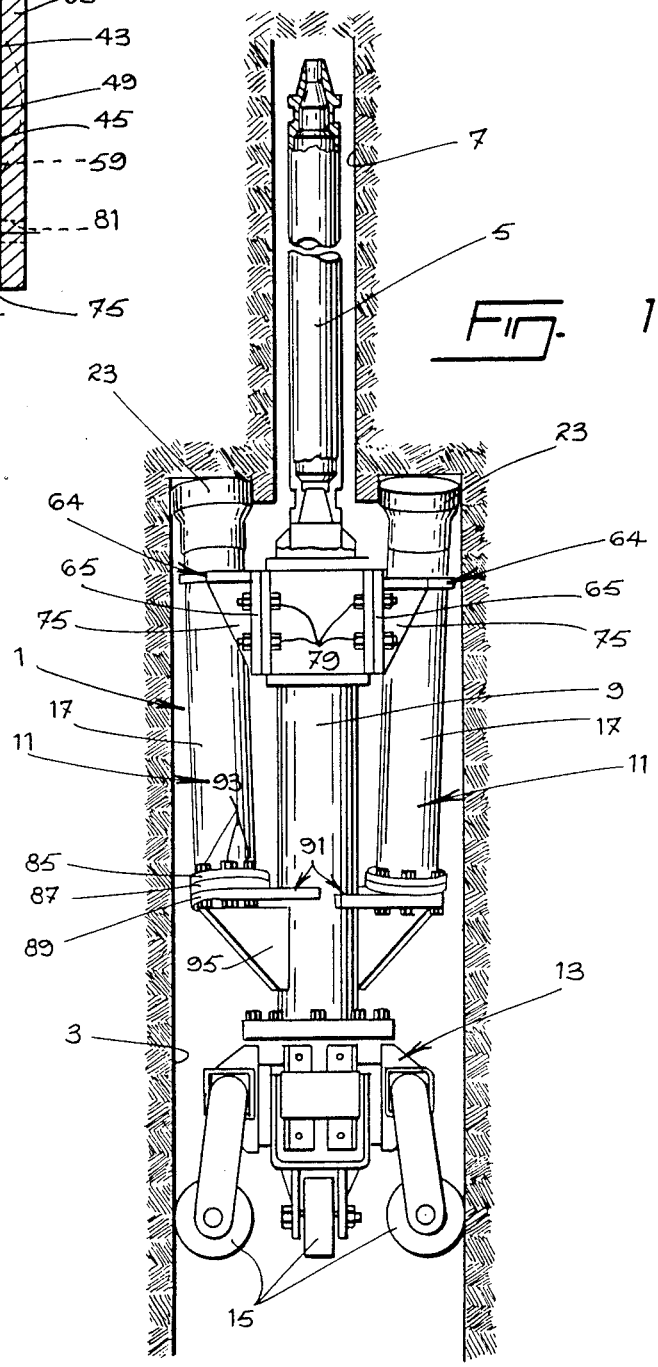
FIG. 1 is a front elevation view of a drill head shown in operation in a mine, said head carrying a pair of impact hammers according to the invention.

FIG. 1 is a general illustration of a drill head 1 for drilling circular holes, such as, for example, a mine ventilation shaft 3. This drill head 1 is connected to a rod or shaft 5, extending in a pilot hole 7 and connected by a driving unit (not shown) on the mine surface. This unit 1 is used to rotate the drill head 1 as a whole via and about the shaft 5. The drill head 1 comprises a central support 9 to which are laterally mounted two or more identical impact hammer assemblies 11. The lower end of the central support 9 is equipped with a know stabilizing arrangement 13 involving pressure rollers 15 resiliently applied against the mine shaft 3 both to absorb vibrations and to guide the drill head 1 during operation.

The basic structure, operation and advantages of this drill head 1 are known per se and form the subject matter of U.S. Pat. No. 4,410,053 referred to hereinabove.

Figure 4:
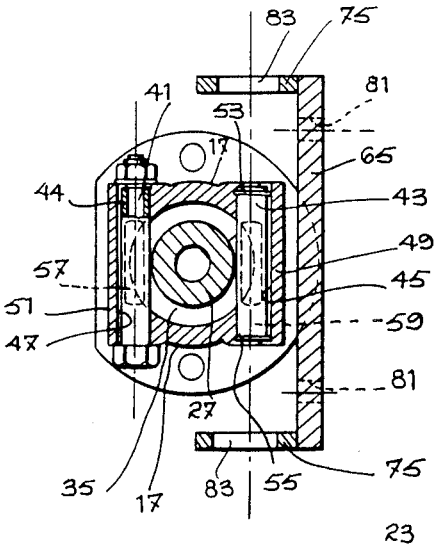
FIG. 4 is a cross-sectional view along line B—B of FIG. 3.
Figure 2:
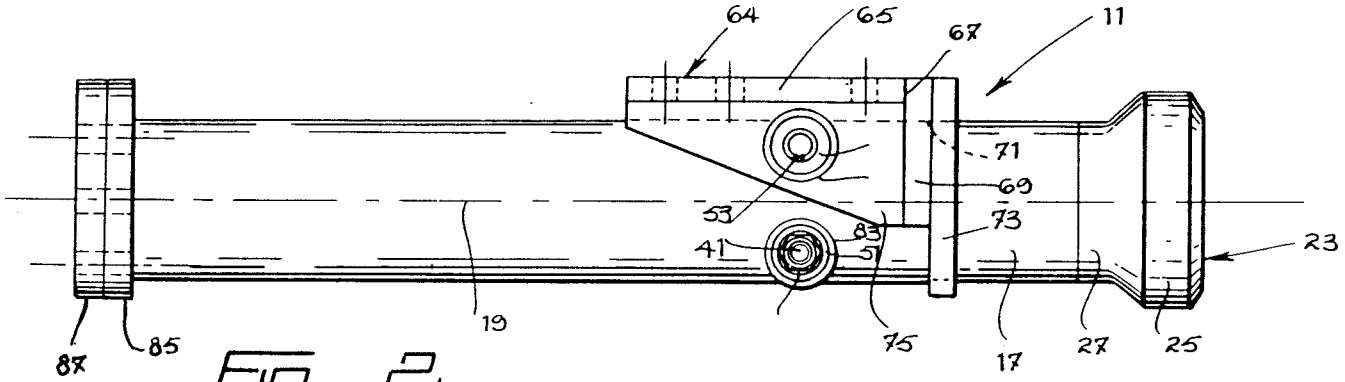
FIG. 2 is a side elevation view of an impact hammer according to the invention.
Figure 3:
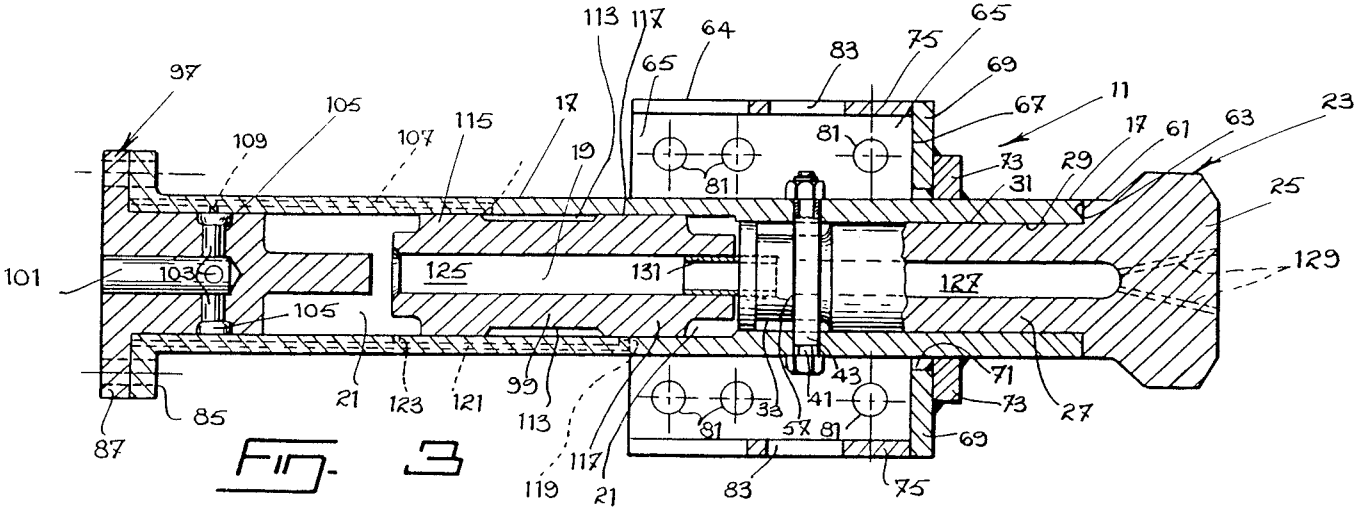
FIG. 3 is a cross-sectional view along line A—A of FIG. 2.

The invention is concerned with the particular structure of the impact hammer assemblies 11 shown in FIG. 1, which structure is shown in greater detail in FIGS. 2 to 4 to which reference is now made. As aforesaid, the drill head 1 may have two or more like such hammer assemblies 11 so that only one need be described.

The impact hammer assembly 11 essentially comprises an elongated case 17 having a longitudinal axis 19 and an inner housing 21 opening at one end of the case 17. The hammer assembly 11 further has a drill bit 23 of which its forward impact head 25 extends out of the housing 21 while its rearward stem 27 is received in the housing. According to the invention, the stem 27 and the housing 21 are so designed as to allow the stem 27 to rotate freely in the housing 21, about the longitudinal axis 19 of the case and also to allow it to move slidably back and forth in the direction of the same axis. Also according to the invention, means are provided to retain the drill bit 23 in the housing without preventing the slidable movement and free rotation of the stem 27 within the housing 21.

In the preferred embodiment illustrated, the housing 21 includes a straight cylindrical bore 29 and the bit stem 27 is cylindrical over a first portion 31 which has a diameter suitable for the stem 27 to rotate freely in the bore 29. The stem 27 further has a second cylindrical portion 33 of lesser diameter than that of the first portion 31. As seen from FIG. 3, the second portion 33 forms, with the facing part of the case bore 29 and two confining radial annular shoulders 37, 39, a chamber 35. The rear shoulder 37, located at the chamber end away from the impact head 25, acts as a stop shoulder, as will be seen.

The retaining means used to retain the drill bit 23 in the housing 21 comprise a pair of removable pins 41, which may be bolts, extending transversally across the case 17 and passing through the chamber 35 on either side of the bit stem 27 as best shown in FIG. 4 where only one bolt is shown, however. As will be easily understood, the pins 41 act as stop means to retain either directly as shown or indirectly the drill bit 23 and limit the outward movement of this bit when the rear stop shoulder 37 hits them.

For ease in replacing the pins 41, they are preferably loosely enclosed in cylindrical tubular sheaths 43, 44, suitably fitted into holes 45, 47, through the wall of the case 17, more precisely through lateral straight ears 49, 51, cast with the case 17 as shown in FIGS. 2 and 4. The sheaths 43, 44, may be held in position by split resilient holding rings 53, 55, shown only in the hole 45 in FIG. 4 where the pin 41 has been omitted for clarity.

In order for the pins 41 to resist the blows better as they are hit by the rear radial stop shoulders 37 of the chamber 35, these pins may be formed with a flat section 57, 59, facing the shoulders. In such a case, their surrounding sheaths may be appropriately cut out.

As best noted in FIG. 3, the case 17 has a radial annular terminal face 61 at the rightward end; the bit impact head 25 is cylindrical with a larger outer diameter than that of the bit stem 27 and the two define between them a bit radial shoulder 63 opposing the terminal face 61. The two shoulders 61, 63, also form part of the means limiting sliding movement of the drill bit 23, more precisely limiting its inward movement into the housing 21 while, as aforesaid, the shoulder 37 and the pin assemblies 41, 43–41, 44 limit its outward movement.

As shown, the impact hammer assembly 11 also includes a fastening bracket 64 comprising a short connection plate 65 adjacent to the rightward end of the case 17. The plate 65 serves to secure the hammer assembly 11 onto the central support 9 (FIG. 1) of the drill head 1. This plate 65 extends tangentially to the case 17, i.e. in a direction parallel to the longitudinal axis 19 of the case 17. It is also preferably normal to the common transverse plane containing the axes of the two pins 41. For connection purposes to the case 17, the forward edge 67 of the connection plate 65 may be secured to a reinforcing bridge plate 69 which has a half-cylindrical hole 71 circumscribing the outer surface of the case 17. This bridge plate 69 may be fixed to a flat ring 73 secured to the case 17 and, two triangular plates 75 may be used to join the connection plate 65 and the bridge plate 69 above and below the case 17. Securing of these various elements together can be made by welding.

The connection plate 65, and along with it, the complete hammer assembly 11, is fixed to a flat support plate 77 of the central support 9 (FIG. 1) by bolts 79. Appropriate holes 81 are provided for that purpose through the connection plate 65.

Appropriate holes 83 are also provided through the triangular brace plates 75 to give access to the bolts 41 when they are to be replaced, as best depicted in FIG. 4.

The other end of the case 17 is outwardly turned and forms an annular flange 85 seating on a top sub-member 87 which itself seats on a flat base 89 of a support pedestal 91 (FIG. 1). The flange 85, top sub-member 87 and flat base 89 are held together by bolt fastenings 93, the flat base 89 being also secured, as by welding, to the central support 9. The same base 89 may advantageously be secured to a triangular reinforcing bracket 95 also welded to the central support 9. Thus, the drill head 1 is firmly but removably fixed to the central support 9 both at the top and at the bottom.

The top sub-member 87 includes a feeding plug 97 forms part of an impact motor. This motor also includes a linearly reciprocable impact piston 99 positioned behind the drill bit 23. The impact motor further includes an appropriate valve and conduit arrangement for compressed air adapted to ram the piston against the stem 27, causing the bit 23 to impact the rock material to be drilled.

Construction of such an impact motor is well within the skill of the art and need not be described in detail. Suffice it to say that, in principle, compressed air is fed into a central longitudinal bore 101 (FIG. 3) of the top sub-member 97, distributed in radial bores 103 leading into a peripheral plenum chamber 105 whence it is sent into a plurality of admission conduits 107 through connecting ports 109. From conduits 107 and through inlet ports 111, compressed air is fed into a peripheral chamber 113 defined between two wide flanges 115, 117, of the impact piston 99. From chamber 113, air is exhausted through outlet ports 119 into a plurality of discharge conduits 121 leading, through discharge ports 123, into the inner housing 21 and, thence, successively through a central bore 125 of the piston 99, into a blind bore 127 of the bit stem 27 and finally through discharge conduits 129 o the bit impact head 25, out to atmosphere. From the retracted position of the drill head 1, in FIG. 3, where inlet ports 111 open into the chamber 113 at the inward end and where outlet ports 119 are blocked by the flange 117, compressed air forcibly throws the drill bit 23 rightward to impact the rock; the inlet ports 111 then becoming blocked by the flange 115 while the outlet ports 117 become free to open into the chamber 113 for air exhaust. Impact of the drill bit 23 on the rock makes it bounce back from it to resume the retracted position for a new cycle.

The end of the drill bit stem 27 has a cylindrical foot valve 131 (FIG. 3) screwed into it and slidable in the bore 125 of the impact piston 99. It serves to prevent entry of air between the facing terminal surfaces of the stem 27 and of the piston 99 as the two depart from one another, during operation.

What is claimed is:

1. An impact hammer assembly for use on a drill head intended for drilling hard material such as rock, said impact hammer assembly comprising:

an elongated case having a longitudinal axis and comprising an inner housing opening at one end of said case;

a drill bit having a forward impact head extending out of said inner housing and a rearward stem extending within said inner housing, said stem being free to rotate and free to slide in said housing about and along said longitudinal axis;

impact motor means mounted in said inner housing, said impact motor means including a linearly reciprocable impact piston mounted behind the drill bit, and means for imparting a reciprocating motion to said impact piston to cause the same to repeatedly hit the stem of the drill bit for said bit head to impact said hard material, and means for retaining the drill bit in said housing, said retaining means including a pair of pins extending transversally across the elongated case, said pins passing through said inner housing on either side of the stem of the drill bit and acting as stop means inside said housing to limit the slidable displacement of said stem without infering with the free rotation of the same.

2. An impact hammer assembly as claimed in claim 1, further comprising:

a radial flange outwardly projecting at the other end of the elongated case which is opposite to the one opened end thereof, said flange acting as a seat to mount the case onto a flat base and comprising a plurality of bolt-receiving holes to allow fixation of said case onto said flat base; and a fastening bracket comprising a short connection plate rigidly connected to the elongated case close to the one opened end thereof, said connection plate extending tangentially to said base and comprising a plurality of bolt-receiving holes.

3. An impact hammer assembly as claimed in claim 2, wherein said connection plate extends parallel to the pins passing through the housing.

4. An impact hammer assembly as claimed in claim 1, wherein:

the housing includes a straight cylindrical bore;

the bit stem has a first cylindrical portion sized for free rotation in said bore, and a second cylindrical portion of lesser diameter than that of said first portion, said second portion forming, within said case bore, an annular chamber having at one end, away from said impact head, a radial annular stop shoulder; and the pins passing through the housing are so positioned as to extend into said annular chamber on either side of said bit stem in order to limit outward movement of the drill bit when said stop shoulder hits said pins as said drill bit is outwardly slidably displaced.

5. An impact hammer assembly as claimed in claim 4, wherein said pins are each formed with a flat section facing said stop shoulder.

6. An impact hammer assembly as claimed in claim 4, further comprising stationary sheaths surrounding said pins, said pins and sheaths being formed with flat sections facing said stop shoulders.

7. An impact hammer assembly as claimed in claim 4, wherein said case has a radial terminal face at the one end of said case and said bit head is cylindrical with a larger diameter than that of said bit stem, whereby defining therebetween a bit radial shoulder facing said terminal face, said terminal face and said bit radial shoulder serving to limit movement of said bit inwardly of said housing.

8. An impact hammer assembly as claimed in claim 7, wherein said pins are each formed with a flat section facing said stop shoulder.

9. An impact hammer assembly as claimed in claim 7, further comprising stationary sheaths surrounding said pins, said pins and sheaths being formed with flat sections facing said stop shoulders.

10. An impact hammer assembly as claimed in claim 7, further comprising:

a radial flange outwardly projecting at the other end of the elongated case which is opposite to the one opened end thereof, said flange acting as a seat to mount the case onto a flat base and comprising a plurality of bolt-receiving holes to allow fixation of said case onto said flat base; and a fastening bracket comprising a short connection plate rigidly connected to the elongated case dose to the one opened end thereof, said connection plate extending tangentially to said case and comprising a plurality of bolt-receiving holes.

11. An impact hammer assembly as claimed in claim 10, wherein said connection plate extends parallel to the pins passing through the housing.

* * * * *